US005924493A

United States Patent [19]

Hartman et al.

[11] Patent Number: 5,924,493

[45] Date of Patent: Jul. 20, 1999

[54] CYCLE PLANNER FOR AN EARTHMOVING MACHINE

[75] Inventors: Matthew A. Hartman, Bloomington; Adam J. Gudat, Edelstein, both of Ill.

[73] Assignee: Caterpillar Inc., Peoria, Ill.

[21] Appl. No.: 09/076,246

[22] Filed: May 12, 1998

[51] Int. Cl.[6] ..... E02F 3/76; A01B 63/112

[52] U.S. Cl. ..... 172/4.5; 701/50

[58] Field of Search ..... 172/1, 2, 4, 4.5, 172/7; 701/50

[56] References Cited

U.S. PATENT DOCUMENTS

| | | | |
|---|---|---|---|
| 3,994,349 | 11/1976 | Rockwell | 172/1 X |
| 4,022,282 | 5/1977 | Rockwell | 172/1 |
| 4,194,574 | 3/1980 | Benson et al. | 172/7 X |
| 4,630,685 | 12/1986 | Huck, Jr. et al. | 172/7 |
| 4,970,800 | 11/1990 | Takizawa et al. | 701/50 X |
| 5,005,652 | 4/1991 | Johnson | 701/50 X |
| 5,174,385 | 12/1992 | Shinbo et al. | 701/50 X |
| 5,375,663 | 12/1994 | Teach | 172/4.5 |
| 5,493,494 | 2/1996 | Henderson | 701/50 |
| 5,560,431 | 10/1996 | Stratton | 172/2 |
| 5,631,658 | 5/1997 | Gudat | 342/457 |
| 5,735,352 | 4/1998 | Henderson et al. | 701/50 X |
| 5,751,576 | 5/1998 | Monson | 701/50 X |

*Primary Examiner*—Christopher J. Novosad
*Attorney, Agent, or Firm*—Steve D. Lundquist

[57] ABSTRACT

A method for determining a series of work cycles for an earthmoving machine is disclosed. The method includes the steps of determining a plurality of parameters, modeling a volume of material to be moved, planning a series of work cycles to move the volume of material, and determining a level of productivity of the series of work cycles. The method also includes the steps of repeating the above steps a predetermined number of times and choosing an optimal series of work cycles to move the volume of material.

29 Claims, 5 Drawing Sheets

CYCLE PLANNER FOR AN EARTHMOVING MACHINE

TECHNICAL FIELD

This invention relates generally to a method for determining an optimal series of work cycles for an earthmoving machine and, more particularly, to a method for modeling a series of work cycles and responsively determining an optimal series of work cycles for the earthmoving machine.

BACKGROUND ART

Earthmoving machines, e.g., track-type tractors and the like, are frequently used to move earth from a first location to a second location. For example, track-type tractors may be used to move a volume of earth from a first location to expose a layer of ore for subsequent mining. The volume of earth may then be moved to a second location, where the ore has already been mined. This continual process is common in open pit mining operations, as only a relatively small area of ore is exposed at any given time. As a result, the earth that is moved is used to reclaim the portion of the land that has previously been mined.

Mining sites such as the one described above must operate as efficiently as possible to save costs. Currently, the process of moving earth is performed by operators who are required to plan work cycles of the earthmoving machines based on experience and personal preference. It is difficult, if not impossible, for an operator of an earthmoving machine to determine the optimal series of work cycles to move a volume of earth that would result in the most cost efficient operation.

The present invention is directed to overcoming one or more of the problems as set forth above.

DISCLOSURE OF THE INVENTION

In one aspect of the present invention a method for determining a series of work cycles for an earthmoving machine is disclosed. The method includes the steps of determining a plurality of parameters, modeling a volume of material to be moved, planning a series of work cycles to move the volume of material, and determining a level of productivity of the series of work cycles. The method also includes the steps of repeating the above steps a predetermined number of times and choosing an optimal series of work cycles to move the volume of material.

In another aspect of the present invention a method for determining a series of work cycles for an earthmoving machine is disclosed. The method includes the steps of determining a plurality of parameters, modeling a volume of material to be moved, planning a first series of work cycles to move the volume of material, and determining a level of productivity of the first series of work cycles. The method also includes the steps of planning a second series of work cycles to move the volume of material, determining a level of productivity of the second series of work cycles, and choosing one of the first and second series of work cycles to move the volume of material.

In yet another aspect of the present invention a method for modeling a volume of material to be moved by an earthmoving machine is disclosed. The method includes the steps of determining a volume of material to be moved, determining a series of segments of the volume of material, and determining a series of segment work cycles for each segment.

BEST MODE FOR CARRYING OUT THE INVENTION

Figure 1:
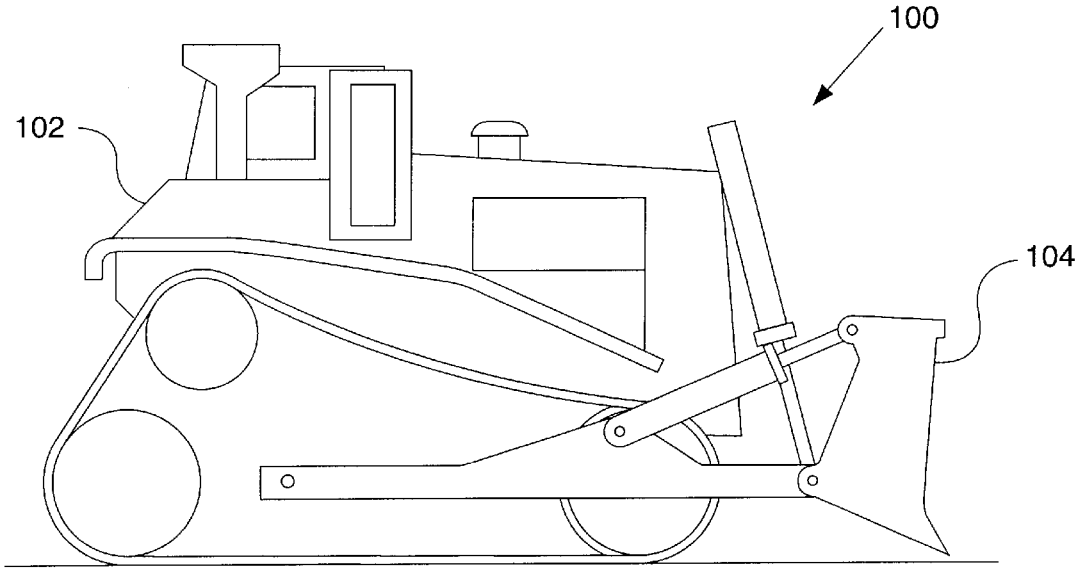
FIG. 1 is a diagrammatic illustration of an earthmoving machine suitable for use with the present invention.

Referring to the drawings, and with particular reference to FIG. 1, a diagrammatic illustration of an earthmoving machine 100 is shown. The earthmoving machine 100 of FIG. 1 is depicted as a track-type tractor 102. However, other types of earthmoving machines, e.g., motor graders, wheel loaders, excavators, and the like, may benefit from use of the present invention. Preferably, the earthmoving machine 100 includes an earthmoving implement 104. As shown in FIG. 1, the track-type tractor 102 includes an earthmoving implement 104, which is depicted as a bulldozer blade. Other types of earthmoving implements may be used with the present invention, e.g., motor grader blades, buckets, scrapers.

Figure 2:
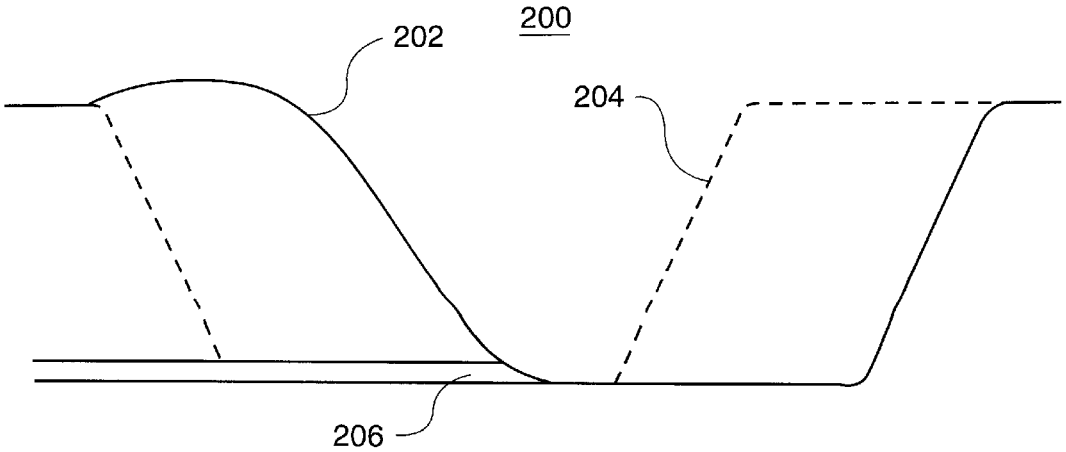
FIG. 2 is a diagrammatic illustration of a work site as embodied for use with one aspect of the present invention.

With reference to FIG. 2, a diagrammatic illustration of a work site 200 as embodied for use with one aspect of the present invention is shown. The work site 200 is shown as an open pit mining site. However, other work sites requiring material to be moved could benefit from the features of the present invention. In the open pit mining site illustrated in FIG. 2, material is moved from a first location 202 to a second location 204 to expose an ore seam 206, e.g., a coal seam, for mining. The second location 204 previously contained material covering the ore seam 206, but was moved in the same manner as above to a third location (not shown). Open pit mining operations where volumes of material are repeatedly shifted to previously mined sections are commonly used in the mining industry. The movement of material exposes ore in relatively small areas, and the moved material is used to reclaim sections of land previously mined.

Figure 3:
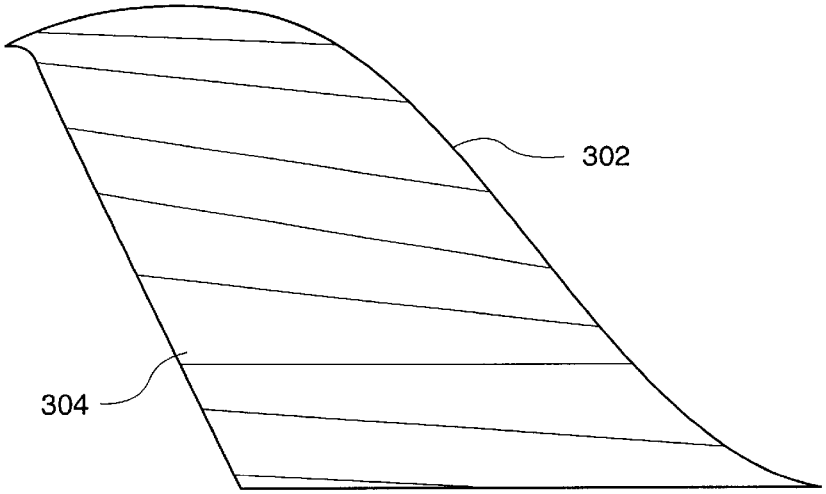
FIG. 3 is a diagrammatic illustration of a volume of material to be moved.
Figure 4:
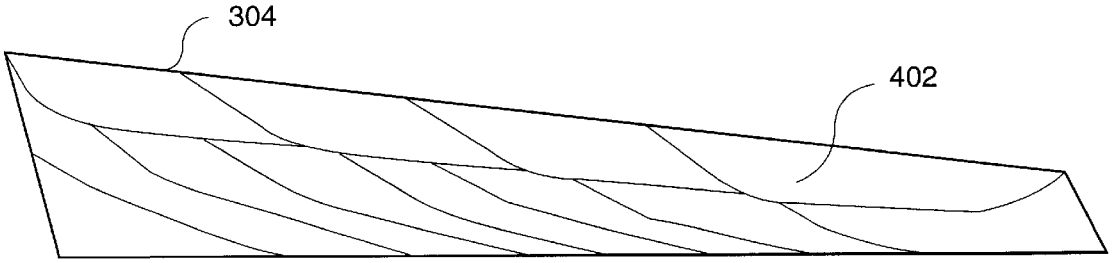
FIG. 4 is a diagrammatic illustration of a segment of material to be moved.

Referring now to FIGS. 3 and 4, and in particular to FIG. 3, a volume of material 302 to be moved is shown. The volume of material 302 typically is created by loosening an area with explosives, resulting in a loose volume of material known as a blast pile. The volume of material 302 may then be moved to the second location 204 using earthmoving machines 100 such as track-type tractors 102.

The volume of material 302 is shown divided into segments in FIG. 3. In FIG. 4, an illustration of a segment of material 304 is shown. The segment of material 304 is further divided up into segment work cycles 402. Preferably, each segment work cycle 402 represents an amount of material that an earthmoving machine 100 is capable of moving in one pass.

In the preferred embodiment, each segment is determined based on an estimated amount of time required to move the segment, e.g., each segment may take one hour to move. The width, shape, and angle of each segment contributes to the estimated amount of time to move the segment.

Preferably, the determination of each segment follows a set of constraints. For example, each segment is preferably created to allow downhill removal of material, the segments sequence from the top of the volume of material 302 to the bottom of the volume of material 302, and each segment is created to be productive for moving material.

Figure 5:
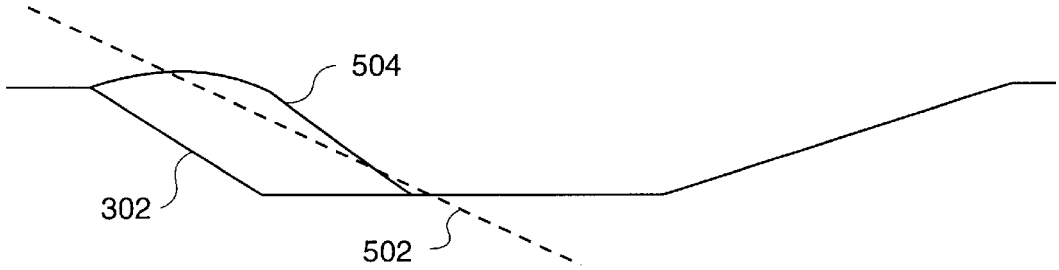
FIG. 5 is a diagrammatic illustration of an aspect of the present invention.

Referring now to FIGS. 5–8, a sequence of steps illustrating an aspect of the present invention is shown. In FIG. 5, a first slice line 502 is drawn through the volume of material 302. The first slice line 502 defines a first segment of material to be moved 504.

Figure 6:
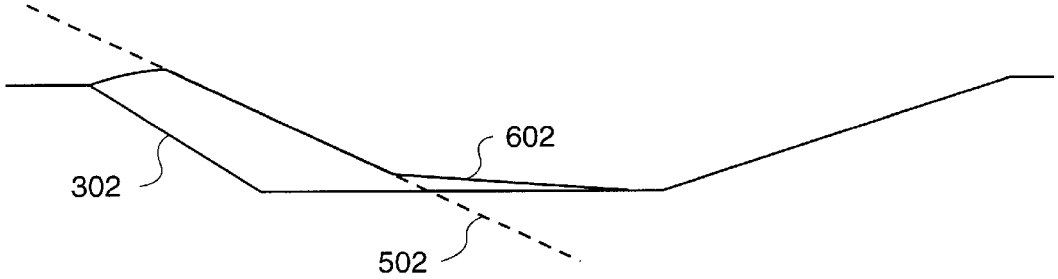
FIG. 6 is a diagrammatic illustration of another aspect of the present invention.
Figure 7:
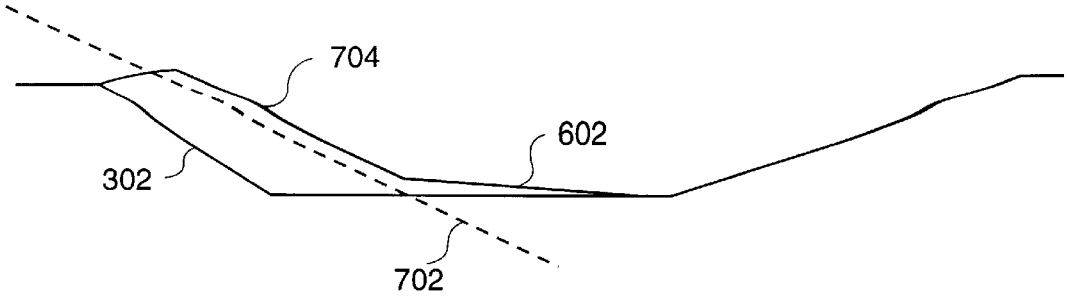
FIG. 7 is a diagrammatic illustration of yet another aspect of the present invention.

In FIG. 6, the first segment of material to be moved 504 has been moved and is depicted as a first segment of material moved 602. In FIG. 7, a second slice line 702 is drawn through the volume of material 302. The second slice line 702 defines a second segment of material to be moved 704.

Figure 8:
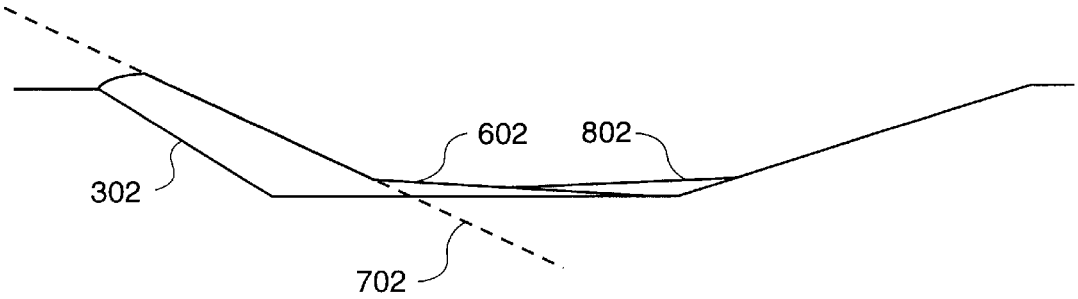
FIG. 8 is a diagrammatic illustration of still another aspect of the present invention.

With reference to FIG. 8, the second segment of material to be moved 704 has been moved and is now depicted as a second segment of material moved 802.

The steps shown in FIGS. 5–8 are repeated until the volume of material 302 has been moved from the first location 202 to the second location 204, thus exposing the ore seam 206, as is shown in FIG. 2.

Figure 9:
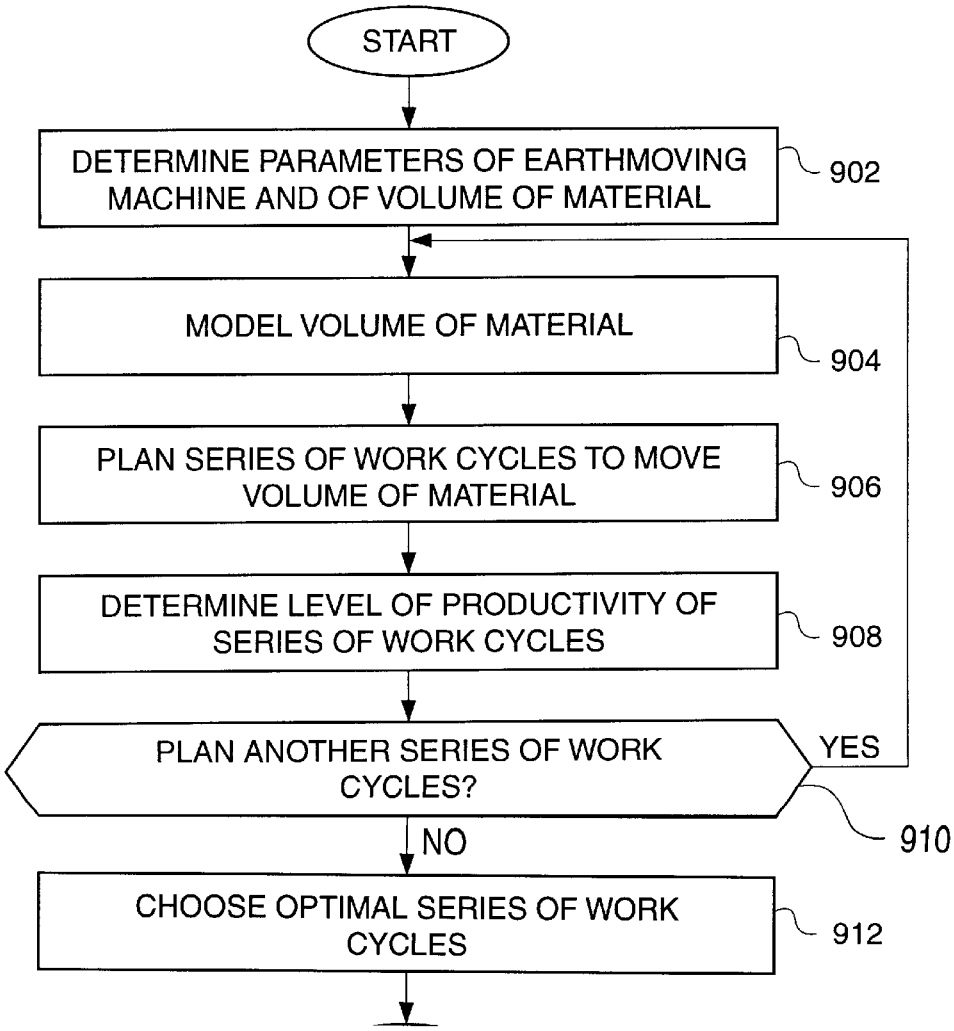
FIG. 9 is a flowchart illustrating an embodiment of the present invention.

Referring now to FIG. 9, a flowchart illustrating a preferred method of the present invention is shown. It is noted that the present invention relates to modeling the volume of material 302 to be moved, and planning a series of work cycles to simulate moving the volume of material 302. The steps are repeated with different series of work cycles to determine an optimal series of work cycles to move the volume of material 302. From these steps in simulation, the earthmoving machine 100 may then be controlled to move the volume of material 302 using the optimal series of work cycles.

In a first control block 902 in FIG. 9, parameters of the earthmoving machine 100 and the volume of material 302 are determined. Parameters of the earthmoving machine 100 may include, but are not limited to, the size of the earthmoving machine 100, the size of the earthmoving implement 104, and the earthmoving capabilities of the earthmoving machine 100, e.g., an available power output of the earthmoving machine 100. Parameters of the volume of material 302 may include, but are not limited to, the composition of the material to be moved, e.g., sand, clay, rock; and the amount of moisture contained in the material. In addition, other parameters, such as the operator's visibility, may be determined.

In a second control block 904, the volume of material 302 to be moved is modeled. In the preferred embodiment, the modeled volume of material 302 is determined from a knowledge of the terrain from GPS, and from basic assumptions of the typical size of an area created as a blast pile.

In a third control block 906, a series of work cycles is planned that would move the volume of material. In the preferred embodiment, the series of work cycles is an accumulation of the segment work cycles for the segments of the volume of material 302. The series of work cycles also includes an order in which the segment work cycles would be performed.

Figure 11:
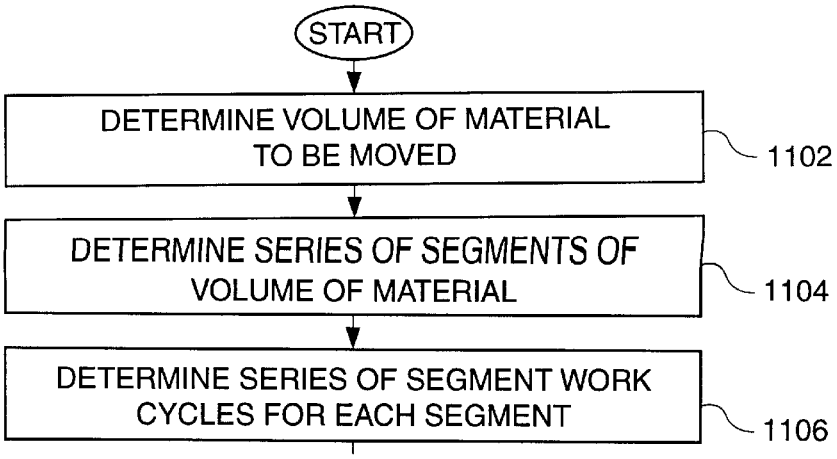
FIG. 11 is a flowchart illustrating a method of segmenting a volume of material.

Referring to FIG. 11, a flowchart illustrating a preferred method for planning a series of work cycles is shown. In a first control block 1102, the volume of material 302 to be moved is determined. In a second control block 1104, a series of segments of the volume of material 302 is determined. In a third control block 1106, a series of segment work cycles for each segment is determined as a function of the parameters of the earthmoving machine 100 and the volume of material 302. The determination of the series of segments and the series of segment work cycles is discussed above in greater detail with reference to FIGS. 3 and 4.

Referring back to FIG. 9, in a fourth control block 908, a level of productivity of the series of work cycles is determined as a function of a predetermined optimization parameter. Preferably, a clock is initialized to zero prior to simulated earthmoving, and the predetermined optimization parameter is a function of time. However, the level of productivity could be a function of some other optimization parameter, such as work performed, machine wear, or fuel usage.

In a first decision block 910, a determination is made to plan another series of work cycles. If the determination is yes, the volume of material 302 is modeled with a new series of segments and a new series of segment work cycles. The new segments are determined by changing the width and the angle of each current segment within constraints. A new series of work cycles is planned which would move the volume of material 302. The level of productivity for the new series of work cycles is determined. The process is repeated a predetermined number of times, with a level of productivity being determined for each planned series of work cycles.

In one embodiment, the number of times for repeating the above steps is determined in response to the level of productivity of the most current planned series of work cycles approaching the predetermined optimization parameter in value. In another embodiment, the number of times for repeating the above steps is determined in response to the difference in the level of productivity of the most current planned series of work cycles compared to the level of productivity of a previous planned series of work cycles being less than a predetermined threshold. Other embodiments for determining the number of times for repeating the above steps could be used without deviating from the spirit of the present invention.

If the decision is made in the first decision block 910 not to plan another series of work cycles, control then proceeds to a fifth control block 912. In the fifth control block 912, the optimal series of work cycles for the earthmoving machine 100 to move the volume of material 302 is chosen. The chosen series of work cycles may then be used to control the earthmoving machine 100 to move the volume of material 302. In one embodiment, operator guidance is provided to allow better manual control of the earthmoving machine 100. In another embodiment, the earthmoving machine 100 is controlled to operate autonomously.

Figure 10:
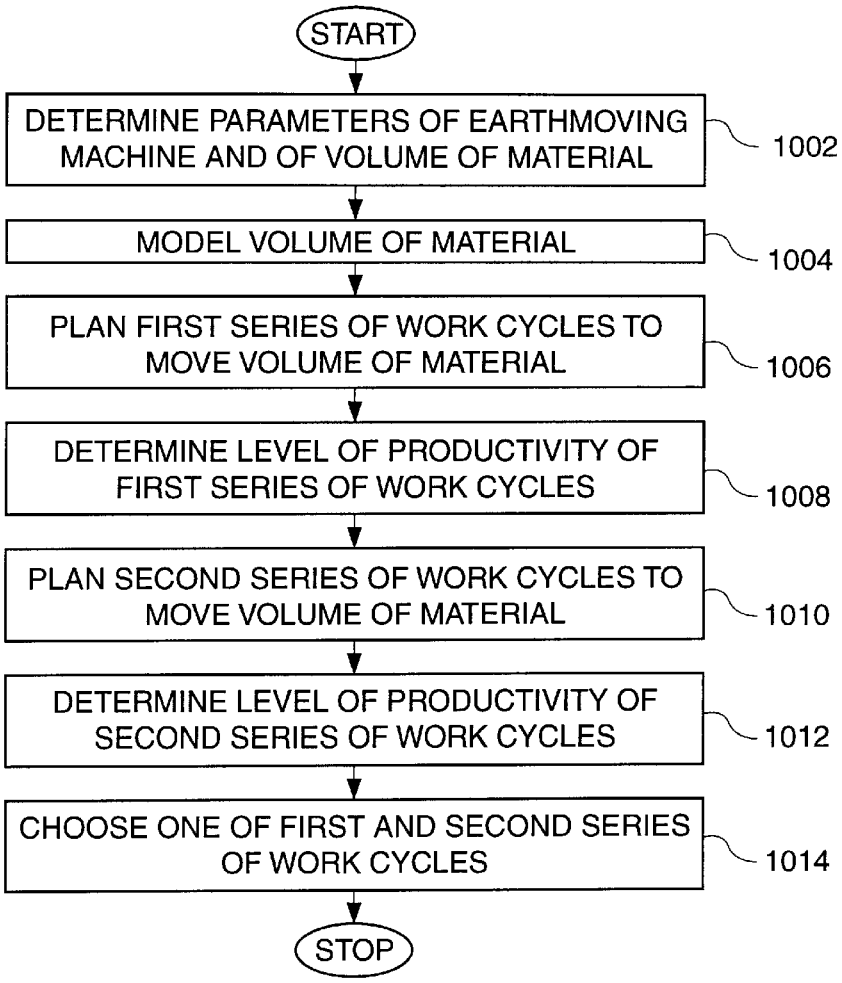
FIG. 10 is a flowchart illustrating another embodiment of the present invention.

Referring now to FIG. 10, a flowchart illustrating an alternate embodiment of the present invention is shown.

In a first control block 1002, parameters of the earthmoving machine 100 and the volume of material 302 are determined. In a second control block 1004, the volume of material 302 is modeled. In a third control block 1006, a first series of work cycles to move the volume of material 302 is planned. In a fourth control block 1008, the level of productivity of the first series of work cycles is determined.

Control then proceeds to a fifth control block 1010, where a second series of work cycles to move the volume of material 302 is planned. In a sixth control block 1012, the level of productivity of the second series of work cycles is determined. In a seventh control block 1014, one of the first and second series of work cycles is chosen as being the most optimal series of work cycles, i.e., having a higher level of productivity.

It is understood that this embodiment may be extended to a third planned series of work cycles, or a fourth, or any desired number of series of work cycles without deviating from the spirit of the invention, as long as one series of work cycles is chosen as having a higher level of productivity than the other series of work cycles.

Industrial Applicability

The present invention provides a method to model and simulate multiple series of work cycles used to move a volume of material from a first location to a second location to determine an optimal series of work cycles to perform the task. The modeling and simulation may be performed by a processor located on board the earthmoving machine 100, or may be performed by a processor located at a remote site, such as at a site office. Once the present invention has determined the optimal series of work cycles, the earthmoving machine 100 may be controlled to perform the desired work cycles to move the material.

Other aspects, objects, and features of the present invention can be obtained from a study of the drawings, the disclosure, and the appended claims.

We claim:

1. A method for determining a series of work cycles for an earthmoving machine, including the steps of:

a) determining a plurality of parameters of the earthmoving machine and of a volume of material to be moved;

b) modeling the volume of material;

c) planning a series of work cycles to move the modeled volume of material;

d) determining a level of productivity of the series of work cycles as a function of a predetermined optimization parameter;

e) repeating steps b) through d) a predetermined number of times; and f) choosing an optimal series of work cycles for the earthmoving machine to move the volume of material.

2. A method, as set forth in claim 1, wherein modeling the volume of material includes the step of determining the volume of the material to be moved.

3. A method, as set forth in claim 2, wherein planning a series of work cycles includes the steps of:

determining a series of segments of the volume of material; and determining a series of segment work cycles for each segment as a function of the plurality of parameters of the earthmoving machine and of the material.

4. A method, as set forth in claim 3, wherein repeating steps b) through d) includes the steps of:

determining an other series of segments of the volume of material; and determining an other series of segment work cycles for each other segment as a function of the plurality of parameters.

5. A method, as set forth in claim 4, wherein determining an other series of segments includes the step of changing a width and an angle of each segment within a set of predetermined constraints.

6. A method, as set forth in claim 1, wherein the plurality of parameters of the earthmoving machine includes machine parameters defining a capability of the earthmoving machine to move an amount of material.

7. A method, as set forth in claim 6, wherein a machine parameter is an available power output of the earthmoving machine.

8. A method, as set forth in claim 6, wherein a machine parameter is a size of an earthmoving implement on the earthmoving machine.

9. A method, as set forth in claim 1, wherein the plurality of parameters of the volume of material to be moved includes characteristics of the material.

10. A method, as set forth in claim 9, wherein a characteristic of the material is the composition of the material.

11. A method, as set forth in claim 9, wherein a characteristic of the material is an amount of moisture contained in the material.

12. A method, as set forth in claim 1, wherein a predetermined optimization parameter is a function of an amount of time required to move the modeled volume of material.

13. A method, as set forth in claim 12, wherein a predetermined number of times for repeating steps b) through d) is determined as a function of the predetermined optimization parameter.

14. A method, as set forth in claim 13, wherein the predetermined number of times is determined in response to the level of productivity of a planned series of work cycles being less than the predetermined optimization parameter.

15. A method, as set forth in claim 13, wherein the predetermined number of times is determined in response to the difference in the level of productivity of a planned series of work cycles compared to the level of productivity of a previous planned series of work cycles being less than a predetermined threshold.

16. A method for determining a series of work cycles for an earthmoving machine, including the steps of:

determining a plurality of parameters of the earthmoving machine and of a volume of material to be moved;

modeling the volume of material;

planning a first series of work cycles to move the modeled volume of material;

determining a level of productivity of the first series of work cycles as a function of a predetermined optimization parameter;

planning a second series of work cycles to move the modeled volume of material;

determining a level of productivity of the second series of work cycles as a function of the predetermined optimization parameter; and choosing one of the first and second series of work cycles for the earthmoving machine to move the volume of material.

17. A method, as set forth in claim 16, wherein modeling the volume of material includes the step of determining the volume of the material to be moved.

18. A method, as set forth in claim 17, wherein planning one of the first and second series of work cycles includes the steps of:

determining a series of segments of the volume of material; and determining a series of segment work cycles for each segment as a function of the plurality of parameters of the earthmoving machine and of the material.

19. A method, as set forth in claim 17, wherein the plurality of parameters of the earthmoving machine includes machine parameters defining a capability of the earthmoving machine to move an amount of material.

20. A method, as set forth in claim 19, wherein a machine parameter is an available power output of the earthmoving machine.

21. A method, as set forth in claim 19, wherein a machine parameter is a size of an earthmoving implement on the earthmoving machine.

22. A method, as set forth in claim 16, wherein the plurality of parameters of the volume of material to be moved includes characteristics of the material.

23. A method, as set forth in claim 22, wherein a characteristic of the material is the composition of the material.

24. A method, as set forth in claim 22, wherein a characteristic of the material is an amount of moisture contained in the material.

25. A method, as set forth in claim 16, wherein a predetermined optimization parameter is a function of an amount of time required to move the modeled volume of material.

26. A method, as set forth in claim 25, wherein choosing one of the first and second series of work cycles includes the step of choosing one of the first and second series of work cycles having a higher level of productivity than the other of the first and second series of work cycles.

27. A method for modeling a volume of material to be moved by an earthmoving machine, including the steps of:

determining a volume of the material to be moved;

determining a series of segments of the volume of material; and determining a series of segment work cycles for each segment as a function of a plurality of parameters of the earthmoving machine and of the material.

28. A method, as set forth in claim 27, further including the steps of:

determining an other series of segments of the volume of material; and determining an other series of segment work cycles for each other segment as a function of the plurality of parameters.

29. A method, as set forth in claim 28, wherein determining an other series of segments includes the step of changing a width and an angle of each segment within a set of predetermined constraints.

* * * * *